US009053671B2

(12) United States Patent
Gao et al.

(10) Patent No.: US 9,053,671 B2
(45) Date of Patent: Jun. 9, 2015

(54) LCD DEVICE AND A TRANSFORMING CIRCUIT THEREOF

(75) Inventors: Xinming Gao, Guandong (CN); Xiang Yang, Guandong (CN); Fei Li, Guandong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 398 days.

(21) Appl. No.: 13/519,377

(22) PCT Filed: May 15, 2012

(86) PCT No.: PCT/CN2012/075485

§ 371 (c)(1),
(2), (4) Date: Jun. 27, 2012

(87) PCT Pub. No.: WO2013/159408

PCT Pub. Date: Oct. 31, 2013

(65) Prior Publication Data

US 2013/0286311 A1 Oct. 31, 2013

(30) Foreign Application Priority Data

Apr. 27, 2012 (CN) ..... 2012 2 0187032

(51) Int. Cl.
*H05B 41/16* (2006.01)
*G09G 3/34* (2006.01)

(52) U.S. Cl.
CPC ..... *G09G 3/3406* (2013.01); *G09G 2330/024* (2013.01)

(58) Field of Classification Search
USPC ..... 315/276, 274, 281–282, 283, 284
See application file for complete search history.

(56) References Cited

U.S. PATENT DOCUMENTS 3,500,170 A * 3/1970 Charrin et al. ..... 363/136
3,964,086 A * 6/1976 Gritter ..... 363/135
5,355,298 A * 10/1994 Seki ..... 363/58

* cited by examiner

*Primary Examiner* — Minh D A
(74) *Attorney, Agent, or Firm* — Andrew C. Cheng

(57) ABSTRACT

The present invention proposes a liquid crystal display device and a transforming circuit thereof. One terminal of a first coil connects to input voltage. One terminal of a energy-storage unit connects to the other terminal of the first coil. One terminal of a second coil connects to the other terminal of the energy-storage unit, and the other terminal of the second coil connects to the light source. An input terminal of a unidirectional unit connects to the one terminal of the first coil which is connected to the input voltage, and the output terminal connected to the one terminal of the second coil which is connected to the light source. A driving signal is fed into a controlling terminal of a switch unit. A first terminal of the switch unit is grounded, and the second terminal of the switch unit is connected a medial point between the first coil and the energy-storage unit.

13 Claims, 2 Drawing Sheets

LCD DEVICE AND A TRANSFORMING CIRCUIT THEREOF

BACKGROUND OF THE INVENTION

1. Field of the Invention

The present invention relates to the field of liquid crystal displays (LCDs), and more particularly, to an LCD device and a transforming circuit thereof.

2. Description of the Prior Art

An LCD device usually comprises an LCD panel and a backlight system. Light produced by the backlight system is transmitted through the LCD panel, which forms images on the LCD panel. The transmission of light is controlled by an orientation of liquid crystal molecules in the LCD panel. The backlight system comprises a light source and a backlight driving circuit. The zoom multiple of the backlight driving circuit is restricted to the maximum duty cycle of a chip, which makes it necessary to increase the zoom multiple of a transforming circuit.

Referring to FIG. 1 showing a conventional transforming circuit which drives a light-emitting diode (LED) light source in the backlight system, the transforming circuit comprises a first coil 110, a second coil 120, and a switch unit 130.

One terminal 111 of the first coil 110 is used for being connected to input voltage. The other terminal 113 of the first coil 110 is used for being connected to one terminal 121 of the second coil 120. The other terminal 123 of the second coil 120 is used for outputting transformed voltage. A controlling terminal 131 of the switch unit 130 is used for inputting a driving signal. A first terminal 133 of the switch unit 130 is used for being grounded. A second terminal 135 of the switch unit 130 is used for being connected to the other terminal 113 of the first coil 110 and to a common terminal of the one terminal 121 of the second coil 120.

When the driving signal causes the switch unit 130 to conduct, voltage applied to the one terminal 111 of the first coil 110 is equal to the input voltage. Voltage applied to the other terminal 113 of the first coil 110 is zero. At this point, the first coil 110 stores energy because of the input voltage. Meanwhile, because of the coupling effect of the first coil 110 and the second coil 120, voltage applied to the other terminal 123 (the output terminal) of the second coil 120 is −N times of the input voltage in which "N" indicates a turns ratio of the second coil 120 to the first coil 110.

The driving signal causes the switch unit 130 to be turned off. Assuming that the voltage applied to the other terminal 113 of the first coil 110 is defined as $V_d$, $V_{in}*T_{on}=(V_d-V_{in})(T-T_{on})$ is satisfied based on the volt-second balance principle in which T indicates a switching period of the switch unit 130, $T_{on}$ indicates conduction time, and $V_{in}$ indicates input voltage. $V_d=V_{in}/(1-D)$ is derived in which $D=T_{on}/T$ is satisfied. At this point, the voltage applied to the other terminal 113 of the first coil 110 is higher than the voltage applied to the one terminal 111 of the first coil 110. The voltage drop between the two terminals 113 and 111 is $V_d-V_{in}=V_{in}*D/(1-D)$. According to the principle of transformation, the voltage drop between the one terminal 121 of the second coil 120 and the other terminal 123 of the second coil 120 is $N*V_{in}*D/(1-D)$. Moreover, the voltage applied to the other terminal 123 is higher than the voltage applied to the one terminal 121. The voltage applied to the one terminal 121 is defined as $V_d$, so the voltage applied to the other terminal 123 is defined as $V_o=V_{in}*(1+N*D)/(1-D)$ in which $V_o$ indicates the voltage applied to the other terminal 123.

However, according to the aforementioned, very high reverse transformed voltage would be output from the other terminal 123 of the second coil 120 when the driving signal forces the switch unit 130 to conduct, i.e., in a non-working state. Due to this reason, a rear-stage circuit needs to have a very high negative-pressure resistance. At this point, the electric current in the second coil 120 would flow into the ground through the switch unit 130 when the switch unit 130 conducts. As a result, loss of energy in the circuit would be inevitable, lowering the effective power in the transforming circuit.

SUMMARY OF THE INVENTION

An object of the present invention is to provide an LCD device and a transforming circuit thereof. The negative-pressure resistance of a rear-stage circuit connected to the transforming circuit does not have to meet a predetermined requirement, which increases the effective power in the transforming circuit.

According to the present invention, a transforming circuit comprises: a first coil, one terminal of the first coil used for being connected to input voltage; a first capacitor, one terminal of the first capacitor used for being connected to the other terminal of the first coil; a second coil, one terminal of the second coil used for being connected to the other terminal of the first capacitor, and the other terminal of the second coil used for being connected to a load; a first diode, comprising an anode and a cathode, the anode used for being connected to the one terminal of the first coil which is connected to the input voltage, and the cathode used for being connected to the one terminal of the second coil which is connected to the load; a switch unit, comprising a controlling terminal, a first terminal, and a second terminal, the controlling terminal used for inputting a driving signal, the first terminal used for being grounded, and the second terminal used for being connected to a medial point between the first coil and the first capacitor. The one terminal of the first coil and the one terminal of the second coil are an in-phase terminal.

In one aspect of the present invention, the circuit comprises a second capacitor, one terminal of the second capacitor is used for being connected to the one terminal of the first coil which is connected to the input voltage, and the other terminal of the second capacitor is used for being grounded.

In another aspect of the present invention, the circuit comprises a second diode serially connected between the second coil and the load, the second diode comprises an anode and a cathode, the anode is used for being connected to the second coil, and the cathode is used for being connected to the load.

In still another aspect of the present invention, the switch unit is a field-effect transistor (FET), and the FET comprises a gate used as the controlling terminal, a source used as the first terminal, and a drain used as the second terminal.

According to the present invention, a transforming circuit comprises: a first coil, one terminal of the first coil connected to input voltage; an energy-storage unit, one terminal of the energy-storage unit connected to the other terminal of the first coil; a second coil, one terminal of the second coil connected to the other terminal of the energy-storage unit, and the other terminal of the second coil connected to a load; a unidirectional unit, comprising an input terminal and an output terminal, the input terminal connected to the one terminal of the first coil which is connected to the input voltage, and the output terminal connected to the one terminal of the second coil which is connected to the load; a switch unit, comprising a controlling terminal, a first terminal, and a second terminal, the controlling terminal used for inputting a driving signal, the first terminal being grounded, and the second terminal connected a medial point between the first coil and the energy-storage unit. The one terminal of the first coil and the one terminal of the second coil are an in-phase terminal.

In one aspect of the present invention, the unidirectional unit is a first diode, the first diode comprises an anode and a cathode, the anode is used as the input terminal of the unidirectional unit, and the cathode is used as the output terminal of the unidirectional unit.

In another aspect of the present invention, the energy-storage unit is a first capacitor.

In another aspect of the present invention, the circuit comprises a second capacitor, one terminal of the second capacitor is connected to the one terminal of the first coil which is connected to the input voltage, and the other terminal of the second capacitor is grounded.

In still another aspect of the present invention, the circuit comprises a second diode serially connected between the second coil and the load, the second diode comprises an anode and a cathode, the anode is connected to the second coil, and the cathode is connected to the load.

In yet another aspect of the present invention, the switch unit is an FET, and the FET comprises a gate used as the controlling terminal, a source used as the first terminal, and a drain used as the second terminal.

According to the present invention, a liquid crystal display device comprises a liquid crystal display panel and a backlight system which comprising a transforming circuit and a light source. The transforming circuit comprises: a first coil, one terminal of the first coil connected to input voltage; an energy-storage unit, one terminal of the energy-storage unit connected to the other terminal of the first coil; a second coil, one terminal of the second coil connected to the other terminal of the energy-storage unit, and the other terminal of the second coil connected to the light source; a unidirectional unit, comprising an input terminal and an output terminal, the input terminal connected to the one terminal of the first coil which is connected to the input voltage, and the output terminal connected to the one terminal of the second coil which is connected to the light source; a switch unit, comprising a controlling terminal, a first terminal, and a second terminal, the controlling terminal used for inputting a driving signal, the first terminal being grounded, and the second terminal connected a medial point between the first coil and the energy-storage unit. The one terminal of the first coil and the one terminal of the second coil are an in-phase terminal.

In one aspect of the present invention, the unidirectional unit is a first diode, the first diode comprises an anode and a cathode, the anode is used as the input terminal of the unidirectional unit, and the cathode is used as the output terminal of the unidirectional unit.

In another aspect of the present invention, the energy-storage unit is a first capacitor.

In another aspect of the present invention, the circuit comprises a second capacitor, one terminal of the second capacitor is connected to the one terminal of the first coil which is connected to the input voltage, and the other terminal of the second capacitor is grounded.

In still another aspect of the present invention, the transforming circuit comprises a second diode serially connected between the second coil and the light source, the second diode comprises an anode and a cathode, the anode is connected to the second coil, and the cathode is connected to the light source.

In yet another aspect of the present invention, the switch unit is an FET, and the FET comprises a gate used as the controlling terminal, a source used as the first terminal, and a drain used as the second terminal.

Compared with the conventional technology, a unidirectional unit and an energy-storage unit are additionally utilized in the circuit in the present invention. So, the present invention has benefits of reducing the reverse voltage output and lowering the requirement for the negative-pressure resistance of a rear-stage circuit. The conduction of the switch unit forces the unidirectional unit to conduct. The conduction of the unidirectional unit causes the voltage applied to the output terminal of the second coil to be clamped on. Another benefit of the present invention is an increase in the effective power of the transforming circuit. This is because the energy-storage unit stores energy stored in the second coil when the switch unit conducts; the energy-storage unit releases the stored energy when the switch unit is turned off.

DETAILED DESCRIPTION OF THE PREFERRED EMBODIMENTS

The present invention will be more apparent from the following detailed description taken in conjunction with the accompanying drawings.

Figure 1:
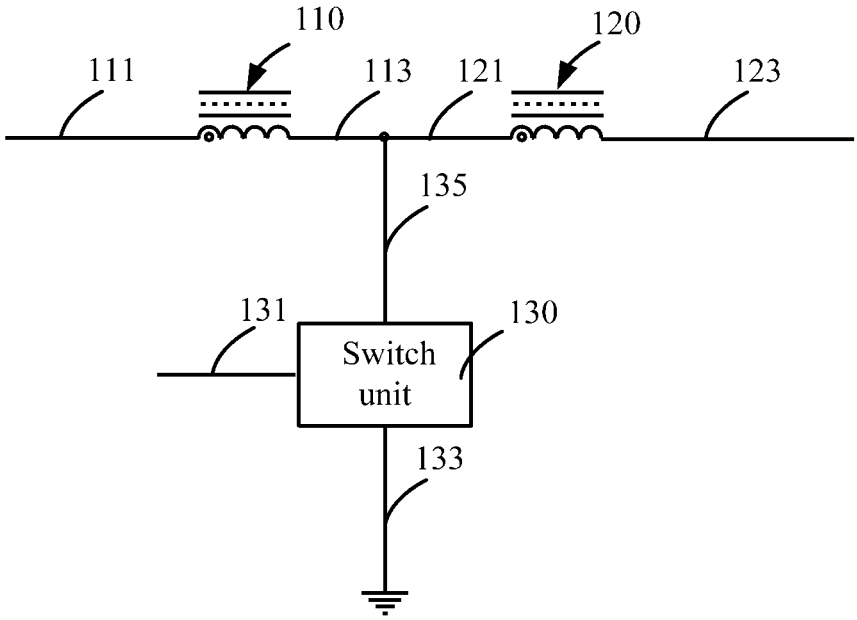
Fig. 1 (Prior Art)
FIG. 1 shows a conventional transforming circuit which drives a light-emitting diode light source in the backlight system.
Figure 2:
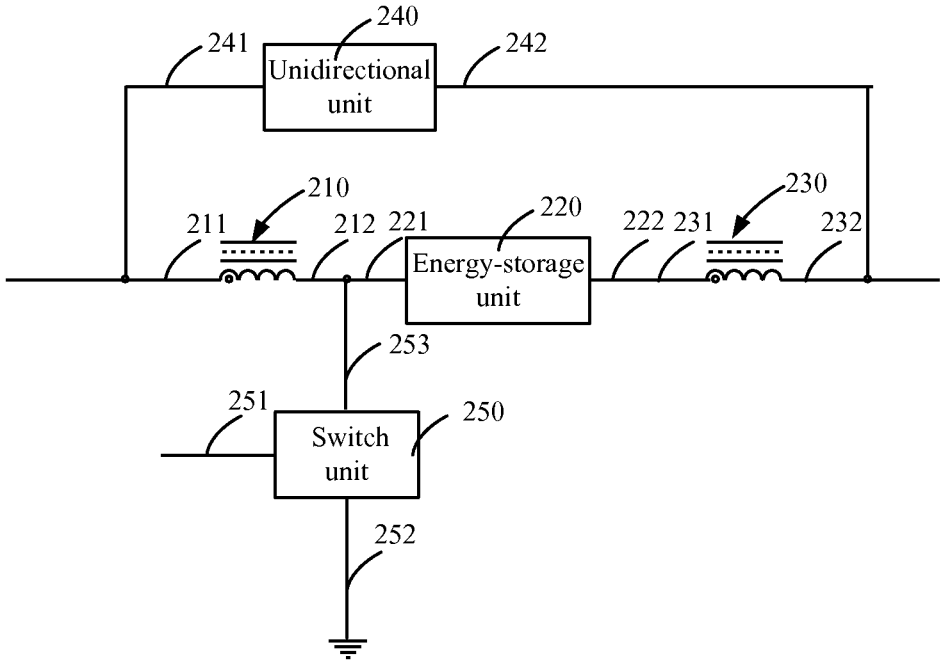
FIG. 2 illustrates a structure diagram of a transforming circuit according to a first embodiment of the present invention.

Please refer to FIG. 2 illustrating a structure diagram of a transforming circuit according to a first embodiment of the present invention. The transforming circuit comprises a first coil 210, an energy-storage unit 220, a second coil 230, a unidirectional unit 240, and a switch unit 250.

The first coil 210 comprises two terminals 211 and 212. The energy-storage unit 220 comprises two terminals 221 and 222. The second coil 230 comprises two terminals 231 and 232. The one terminal 211 of the first coil 210 is used for being connected to input voltage. The other terminal 212 of the first coil 210 is used for being connected to the one terminal 221 of the energy-storage unit 220. The other terminal 222 of the energy-storage unit 220 is used for being connected to the one terminal 231 of the second coil 230. The other terminal 232 of the second coil 230 is used for being connected to a load. The one terminal 211 of the first coil 210 and the one terminal 231 of the second coil 230 are an in-phase terminal. An input terminal 241 of the unidirectional unit 240 is used for being connected to the one terminal 211 of the first coil 210 which is connected to the input voltage. An output terminal 242 of the unidirectional unit 240 is used for being connected to the other terminal 232 of the second coil 230 which is connected to the load. A controlling terminal 251 of the switch unit 250 is used for inputting a driving signal. A first terminal 252 of the switch unit 250 is used for being grounded. A second terminal 253 of the switch unit 250 is used for being connected to a medial point between the first coil 210 and the energy-storage unit 220.

When the driving signal causes the switch unit 250 to be turned on, the voltage applied to the one terminal 211 of the first coil 210 is equal to the input voltage. The voltage applied to the other terminal 212 of the first coil 210 is zero. The first coil 210 stores energy because of the input voltage. When the input voltage is positive, negative voltage would be produced on the other terminal 232 of the second coil 230, the unidirectional unit 240 would conduct, and the voltage of the other terminal 232 of the second coil 230 would be clamped on the voltage which is equal to the input voltage. Because of the coupling effect of the first coil 210 and the second coil 230, the voltage drop between the one terminal 231 and the other terminal 232 is N times of the voltage drop between the one terminal 211 and the other terminal 212, that is N times of the input voltage. It is notified that "N" indicates a turns ratio of the second coil 230 to the first coil 210. The voltage applied to the other terminal 232 of the second coil 230 is equal to the input voltage. The voltage drop between the one terminal 231 and the other terminal 232 is N times of the input voltage. The voltage applied to the other terminal 222 of the energy-storage unit 220 is the sum of the voltage applied to the other terminal 232 and the voltage drop between the one terminal 231 and the other terminal 232, that is, $V_0+NV_0=(N+1)V_0$ or (N+1) times of the input voltage. At this point, the energy-storage unit 220 starts to store energy.

The driving signal causes the switch unit 250 to be turned Off. Assuming that the voltage applied to the other terminal 212 of the first coil 210 is defined as $V_d$, $V_{in}*T_{on}=(V_d-V_{in})(T-T_{on})$ is satisfied based on the volt-second balance principle in which T indicates a switching period of the switch unit 250, $T_{on}$ indicates conduction time, and $V_{in}$ indicates input voltage. $V_d=/(1-D)$ is derived in which $D=T_{on}/T$ is satisfied. At this point, the voltage applied to the other terminal 212 of the first coil 210 is higher than the voltage applied to the one terminal 211 of the first coil 210. The voltage drop between the two terminals 211 and 212 is $V_d-V_{in}=V_{in}*D/(1-D)$. According to the principle of transformation, the voltage drop between the two terminals 231 and 232 is $N*V_{in}*D/(1-D)$. Since the voltage applied to the terminals 221 and 222 could not suddenly change, the voltage applied to the other terminal 222 is $(N+1)*V_{in}+V_{in}/(1-D)$. According to Kirchhoff's Voltage Law, the voltage applied to the other terminal 232 is $(N+1)*V_{in}+V_{in}/(1-D)+V_{in}*D/(1-D)$. In other words, the energy-storage unit 220 stores energy stored in the second coil 230 when the switch unit 250 conducts; the energy-storage unit 220 releases the stored energy when the switch unit 250 is turned off.

Figure 3:
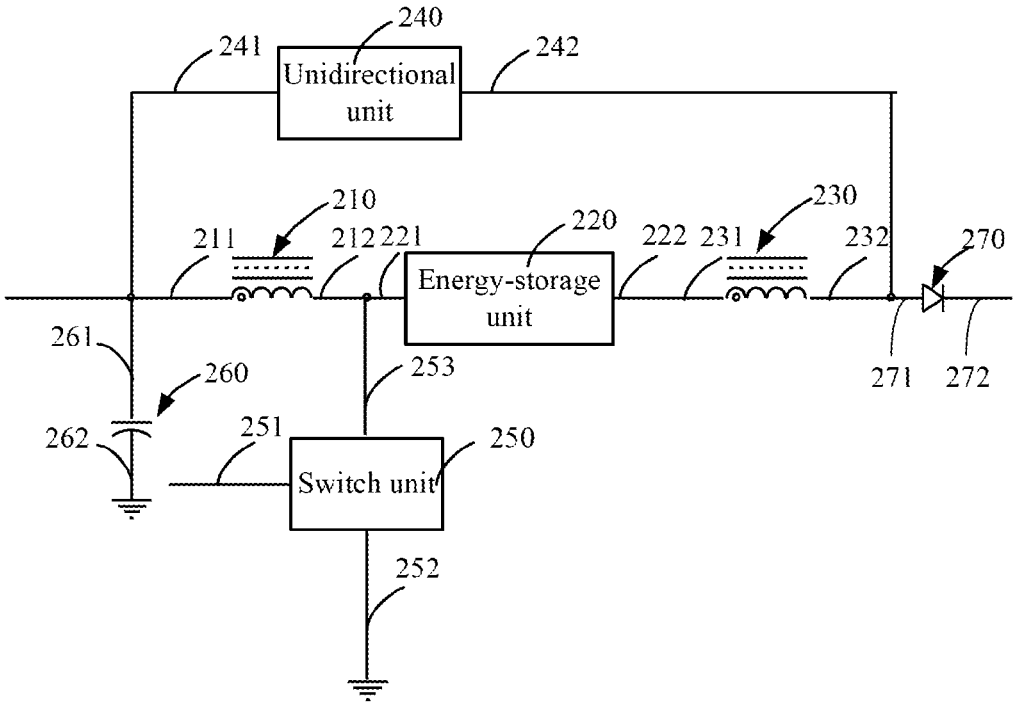
FIG. 3 illustrating a structure diagram of the transforming circuit according to a second embodiment of the present invention.

Please refer to FIG. 3 illustrating a structure diagram of the transforming circuit according to a second embodiment of the present invention. Differing from the second embodiment, the third embodiment additionally comprises a second capacitor 260 and a second diode 270. One terminal 261 of the second capacitor 260 is used for being connected to the one terminal 211 of the first coil 210 which is connected to the input voltage. The other terminal 262 of the second capacitor 260 is used for being grounded. The second coil 230 could filter the input voltage, which prevents a rear-stage circuit from being affected by rippled waves. The second diode 270 is serially connected between the second coil 230 and the load. The second diode 270 comprises an anode 271 and a cathode 272. The anode 271 is used for being connected to the second coil 230. The cathode 272 is used for being connected to the load. When the other terminal 232 of the second coil 230 outputs the negative voltage, the second diode 270 would be cut off: As a result, the load would not be affected by the negative voltage.

It is noted that, because of the disposition of the unidirectional unit 240, the voltage applied to the other terminal 232 of the second coil 230 is clamped on the voltage which is equal to the input voltage when the switch unit 250 turns on. So the diode 270 could be a diode having a lower resistance to pressure, which helps reduce production costs and helps improve the reliability of the circuit.

Figure 4:
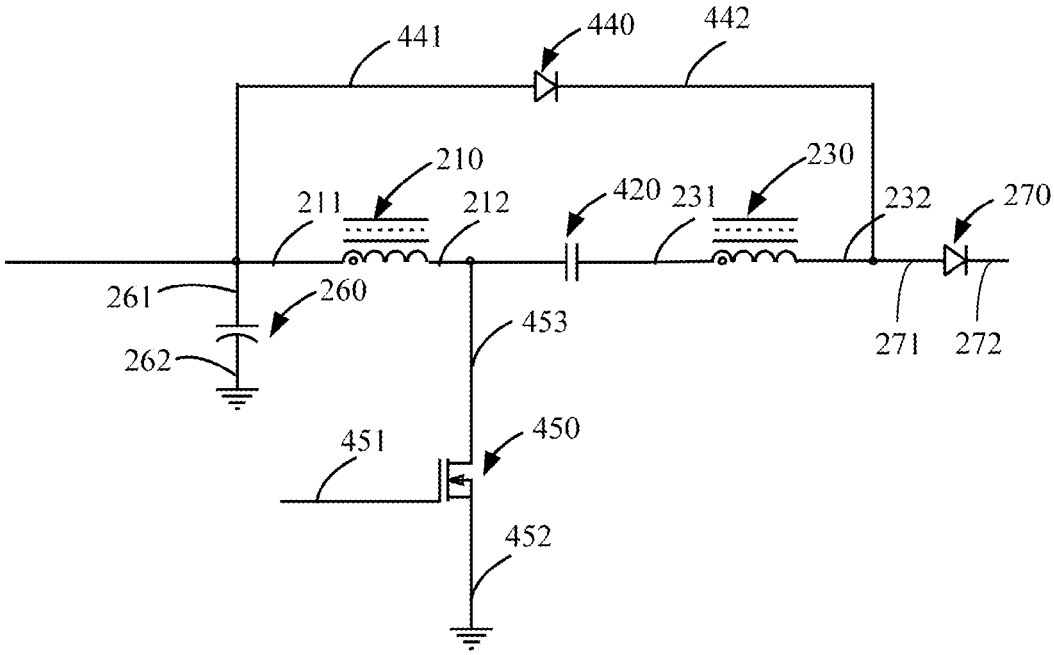
FIG. 4 illustrates a circuit associated with the circuit shown in FIG. 3.

Please refer to FIG. 4 illustrating a circuit associated with the circuit shown in FIG. 3. Differences between the embodiment shown in FIG. 4 and the embodiment shown in FIG. 3 are described as follows. In the embodiment shown in FIG. 4, the energy-storage unit is a first capacitor 420. The function of the first capacitor 420 in the present embodiment is the same as that in the third embodiment. Thus, the detailed description will not herein be repeated. The unidirectional unit 240 is a first diode 440. The first diode 440 comprises an anode 441 and a cathode 442. The anode 441 is used as an input terminal 241 of the unidirectional unit 240. The cathode 442 is used as an output terminal 242 of the unidirectional unit 240. When the positive voltage is applied to the anode 441, the first diode 440 would conduct. Contrarily, when the positive voltage is not applied to the anode 441, the first diode 440 would be cut off. The switch unit 250 is a field-effect transistor (FET) 450. The FET 450 comprises a gate 451 used as a controlling terminal, a source 452 used as a first terminal, and a drain 453 used as a second terminal. The driving signal of the high level voltage causes the FET 450 to conduct and the source 452 to be grounded, so that voltage applied to the drain 453 is zero. The driving signal of the high level voltage causes the FET 450 to be cut off.

It is noted that the energy-storage unit 220 could be a plurality of capacitors in series, an energy-storage component, or a combination of energy-storage components. A detailed description thereof will not be repeated.

Similarly, the unidirectional unit 240 could be a plurality of diodes in series, a unidirectionally conductive component, or a combination of unidirectionally conductive components. A detailed description thereof will not be repeated.

Moreover, a backlight driving circuit is provided by the present invention. The backlight driving circuit comprises the transforming circuit introduced in each of the above-mentioned embodiments.

Furthermore, a backlight system is provided by the present invention. The backlight system comprises an LED light source and a backlight driving circuit. The backlight driving circuit comprises the transforming circuit introduced in each of the above-mentioned embodiments. The LED light source is the load.

In addition, an LCD device is provided by the present invention. The LCD device comprises an LCD panel and a backlight system. The transforming circuit is disposed on the backlight system. The transforming circuit is like the one introduced in each of the above-mentioned embodiments Differing from the conventional technology, the unidirectional unit 240 and the energy-storage unit 220 are additionally utilized in the circuit in the present invention. The conduction of the switch unit 250 forces the unidirectional unit 240 to conduct. The conduction of the unidirectional unit 240 causes the voltage applied to the output terminal 242 of the second coil 230 to be clamped on, resulting in a decrease in reverse output voltage. Thus, the negative-pressure resistance of the rear-stage circuit does not have to conform to the predetermined requirement. When the switch unit 250 conducts, the energy-storage unit 220 stores energy stored in the second coil 230. When the switch unit 250 is turned off the energy-storage unit 220 releases the stored energy. In this way, the effective power of the transforming circuit is increased.

While the present invention has been described in connection with what is considered the most practical and preferred embodiments, it is understood that this invention is not limited to the disclosed embodiments but is intended to cover various arrangements made without departing from the scope of the broadest interpretation of the appended claims.

What is claimed is:

1. A transforming circuit, comprising:

a first coil, one terminal of the first coil used for being connected to input voltage;

a first capacitor, one terminal of the first capacitor used for being connected to the other terminal of the first coil;

a second coil, one terminal of the second coil used for being connected to the other terminal of the first capacitor, and the other terminal of the second coil used for being connected to a load;

a first diode, comprising an anode and a cathode, the anode used for being connected to the one terminal of the first coil which is connected to the input voltage, and the cathode used for being connected to the one terminal of the second coil which is connected to the load;

a switch unit, comprising a controlling terminal, a first terminal, and a second terminal, the controlling terminal used for inputting a driving signal, the first terminal used for being grounded, and the second terminal used for being connected to a medial point between the first coil and the first capacitor;

a second capacitor, one terminal of the second capacitor used for being connected to the one terminal of the first coil which is connected to the input voltage, and the other terminal of the second capacitor used for being rounded; and wherein the one terminal of the first coil and the one terminal of the second coil are an in-phase terminal.

2. The circuit as claimed in claim 1, wherein the circuit comprises a second diode serially connected between the second coil and the load, the second diode comprises an anode and a cathode, the anode is used for being connected to the second coil, and the cathode is used for being connected to the load.

3. The circuit as claimed in claim 1, wherein the switch unit is a field-effect transistor (FET), and the FET comprises a gate used as the controlling terminal, a source used as the first terminal, and a drain used as the second terminal.

4. A transforming circuit, comprising:

a first coil, one terminal of the first coil connected to input voltage;

an energy-storage unit, one terminal of the energy-storage unit connected to the other terminal of the first coil;

a second coil, one terminal of the second coil connected to the other terminal of the energy-storage unit, and the other terminal of the second coil connected to a load;

a unidirectional unit, comprising an input terminal and an output terminal, the input terminal connected to the one terminal of the first coil which is connected to the input voltage, and the output terminal connected to the one terminal of the second coil which is connected to the load;

a switch unit, comprising a controlling terminal, a first terminal, and a second terminal, the controlling terminal used for inputting a driving signal, the first terminal being grounded, and the second terminal connected a medial point between the first coil and the energy-storage unit;

a second capacitor, one terminal of the second capacitor connected to the one terminal of the first coil which is connected to the input voltage, and the other terminal of the second capacitor being grounded; and wherein the one terminal of the first coil and the one terminal of the second coil are an in-phase terminal.

5. The circuit as claimed in claim 4, wherein the unidirectional unit is a first diode, the first diode comprises an anode and a cathode, the anode is used as the input terminal of the unidirectional unit, and the cathode is used as the output terminal of the unidirectional unit.

6. The circuit as claimed in claim 4, wherein the energy-storage unit is a first capacitor.

7. The circuit as claimed in claim 4, wherein the circuit comprises a second diode serially connected between the second coil and the load, the second diode comprises an anode and a cathode, the anode is connected to the second coil, and the cathode is connected to the load.

8. The circuit as claimed in claim 4, wherein the switch unit is an FET, and the FET comprises a gate used as the controlling terminal, a source used as the first terminal, and a drain used as the second terminal.

9. A liquid crystal display device comprising a liquid crystal display panel and a backlight system which comprising a transforming circuit and a light source, the transforming circuit comprising:

a first coil, one terminal of the first coil connected to input voltage;

an energy-storage unit, one terminal of the energy-storage unit connected to the other terminal of the first coil;

a second coil, one terminal of the second coil connected to the other terminal of the energy-storage unit, and the other terminal of the second coil connected to the light source;

a unidirectional unit, comprising an input terminal and an output terminal, the input terminal connected to the one terminal of the first coil which is connected to the input voltage, and the output terminal connected to the one terminal of the second coil which is connected to the light source;

a switch unit, comprising a controlling terminal, a first terminal, and a second terminal, the controlling terminal used for inputting a driving signal, the first terminal being grounded, and the second terminal connected a medial point between the first coil and the energy-storage unit;

a second capacitor, one terminal of the second capacitor connected to the one terminal of the first coil which is connected to the input voltage, and the other terminal of the second capacitor being grounded; and wherein the one terminal of the first coil and the one terminal of the second coil are an in-phase terminal.

10. The liquid crystal display device as claimed in claim 9, wherein the unidirectional unit is a first diode, the first diode comprises an anode and a cathode, the anode is used as the input terminal of the unidirectional unit, and the cathode is used as the output terminal of the unidirectional unit.

11. The liquid crystal display device as claimed in claim 9, wherein the energy-storage unit is a first capacitor.

12. The liquid crystal display device as claimed in claim 9, wherein the transforming circuit comprises a second diode serially connected between the second coil and the light source, the second diode comprises an anode and a cathode, the anode is connected to the second coil, and the cathode is connected to the light source.

13. The liquid crystal display device as claimed in claim 9, wherein the switch unit is an FET, and the FET comprises a gate used as the controlling terminal, a source used as the first terminal, and a drain used as the second terminal.

* * * * *